United States Patent [19]

Bosley

[11] 4,200,289

[45] Apr. 29, 1980

[54] MAGNETIC GAME APPARATUS

[75] Inventor: Thurston N. Bosley, Lynnwood, Wash.

[73] Assignee: Jemar, Inc., Renton, Wash.

[21] Appl. No.: 910,422

[22] Filed: May 30, 1978

[51] Int. Cl.[2] ..... A63F 7/16

[52] U.S. Cl. ..... 273/109; 273/126 A; 273/1 M; 273/128 R

[58] Field of Search ..... 273/1 M, 118 A, 121 A, 273/122 A, 123 A, 124 A, 125 A, 126 A, 119 A, 110, 109, 128 R; 46/45, 238, 239, 240

[56] References Cited

U.S. PATENT DOCUMENTS

| | | | |
|---|---|---|---|
| 2,665,912 | 1/1954 | Juran | 273/118 A |
| 2,940,216 | 6/1960 | Koch | 46/238 |
| 3,116,929 | 1/1964 | Kernodle | 273/1 M |
| 3,408,072 | 10/1968 | Luchsinger | 273/123 A |
| 3,967,824 | 7/1976 | Lund | 273/1 M |
| 4,043,558 | 8/1977 | Star | 273/110 |

*Primary Examiner*—Richard C. Pinkham
*Assistant Examiner*—T. Brown
*Attorney, Agent, or Firm*—Robert W. Beach; Ward Brown

[57] ABSTRACT

A planar nonmagnetic sheet is mounted in an open topped container with the top of such sheet spaced from the bottom of the container and edge portions of the sheet spaced from the inner sides of the container. The top of such sheet forms a playing surface for a playing piece or wobbler having a low center of gravity and a convexly curved bottom. Lower board magnets are located beneath the playing surface sheet at the four corners of a square. An upper board magnet is positioned above the playing surface sheet at the center of such square. Another magnet is carried by the wobbler. All of the magnets, including the lower board magnets, the upper board magnet and the wobbler magnet, are short cylindrical bar magnets oriented such that the same pole of each is generally adjacent to the playing surface, and the other pole of each is farther from the playing surface, so that the board magnets provide a magnetic field repelling the wobbler. Tilting of the container causes the wobbler to spin or wobble and move over the playing surface. By expert manipulation of the container the wobbler can be made to traverse any of a variety of different circuitous paths over the playing surface without skidding or travelling beyond an edge of the playing surface to fall into the container.

12 Claims, 6 Drawing Figures

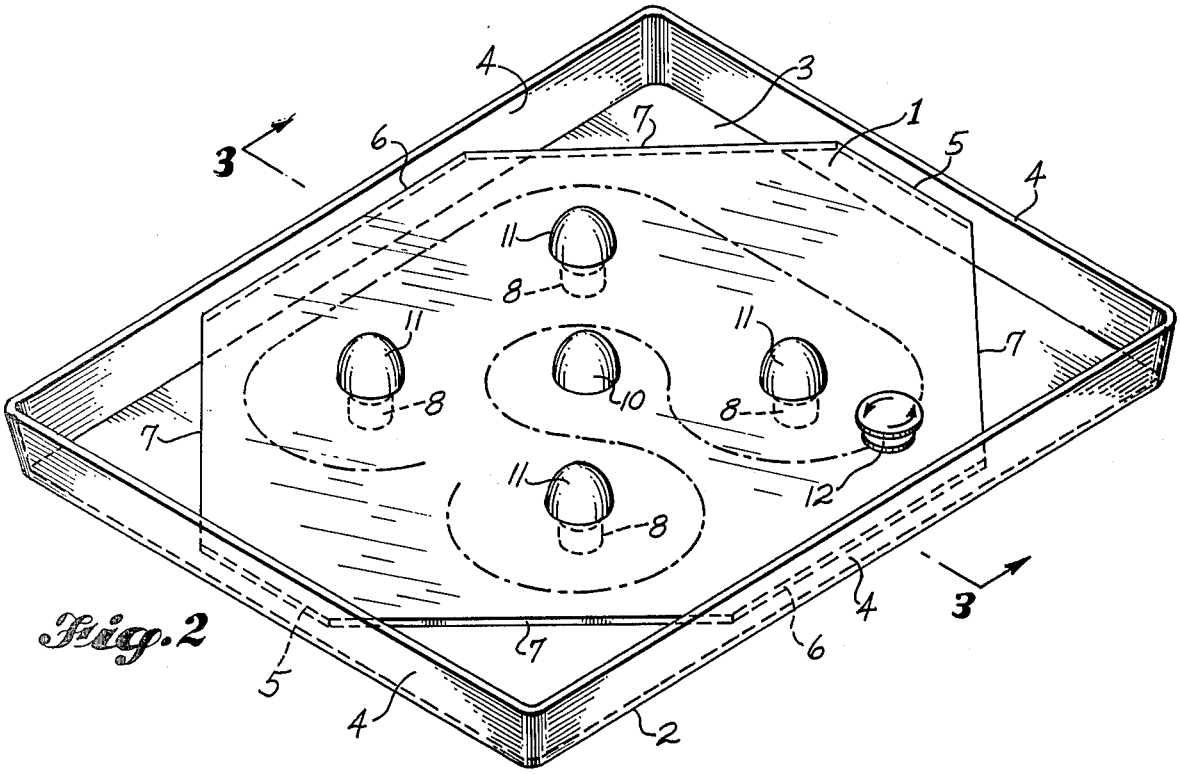
Fig. 2
Fig. 3
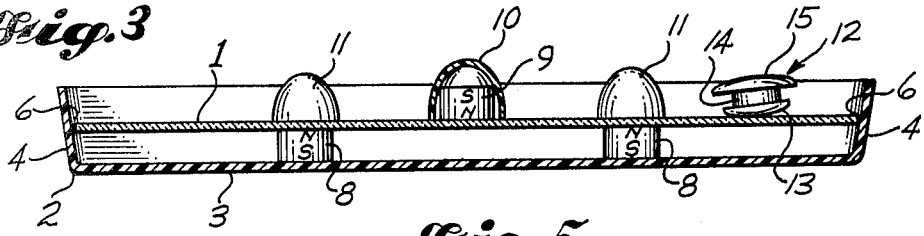
Fig. 5
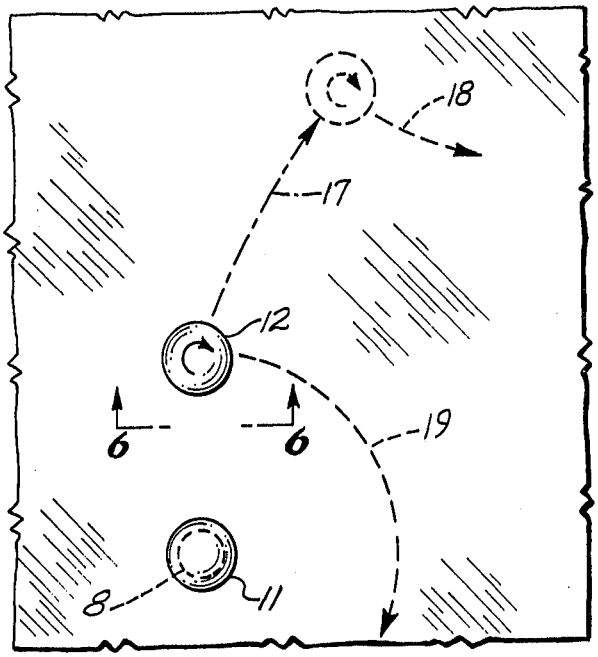
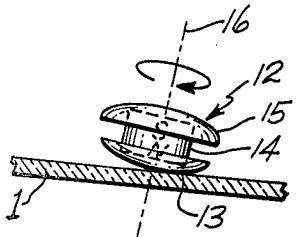
Fig. 6
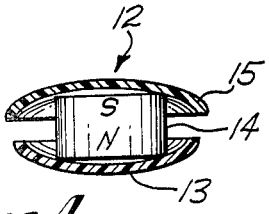
Fig. 4

MAGNETIC GAME APPARATUS

BACKGROUND OF THE INVENTION

1. Field of the Invention

The present invention relates to an amusement device of the type including a tiltable game board and a separate playing piece for traversing a circuitous path over the game board in response to tilting of the game board.

2. Patented Art

The "Game Board Unit" of U.S. Pat. No. 3,967,824 includes a flat, universally tiltable game board; rows of magnets and nonmagnetic pegs mounted on the game board and defining the opposite sides of a specific circuitous path; and a "magnetically responsive" ball for rolling along the path in response to tilting of the board. The object of the game played with such game board unit is to cause the ball to traverse the path from its start to its finish without the ball being trapped against any of the magnets bordering the path.

The "Magnetic Maze Game" of U.S. Pat. No. 4,043,558 resulting from an application filed after development of the present invention, includes a hand-held, planar playing surface; magnets mounted on such surface and defining a specific path; and a playing piece magnet for traversing such path in response to tilting of the playing surface. The playing piece magnet has a planar bottom and is slid along the path, preferaby without being attracted and trapped by a board-mounted magnet and without being pushed out of the path by being repelled by a board-mounted magnet.

SUMMARY OF THE INVENTION

The principal object of the present invention is to provide an amusement device of the type including a tiltable playing surface and a playing piece for traversing a circuitous path over such surface in response to tilting thereof, which device provides a large number of different circuitous paths to be traversed by the playing piece.

Another object is to provide such device in which several of the possible circuitous paths are endless so that the playing piece can be moved substantially continuously, rather than repetitively from a specified start to a specified finish.

It is also an object to provide such a device in which traversal of the various paths requires varying degrees of skill so that a beginner can cause the playing piece to traverse the simplest path, yet even an expert has difficulty in causing the playing piece to traverse the most difficult path.

An additional object is to effect spinning and wobbling movement downhill of a playing piece having a convex bottom on an inclined surface instead of such playing piece merely sliding down such surface.

A further object is to provide such a device which is of simple and inexpensive, yet sturdy, construction.

The foregoing objects can be accomplished by providing a nonmagnetic playing surface, at least one board magnet located beneath the playing surface and a playing piece including a magnet and having a convexly curved bottom for spinning or wobbling in traversing a circuitous path over the playing surface. The board magnet and the playing piece magnet are disposed such that when the playing piece bottom is in engagement with the playing surface the same pole of each of such magnets is generally adjacent to the playing surface, and the other pole of each of such magnets is farther from the playing surface, so that the playing piece magnet is repelled by the board magnet.

In the preferred embodiment of the invention, four board magnets are mounted beneath the playing surface and are located, respectively, at each of the four corners of a square. An upper board magnet is mounted above the playing surface and is located at the center of the square.

BRIEF DESCRIPTION OF THE DRAWINGS

FIG. 2 is a top perspective of such apparatus assembled.

FIG. 3 is a section taken on line 3—3 of FIG. 1.

FIG. 4 is an enlarged axial section of the playing piece used in the present invention.

FIG. 5 is a somewhat diagrammatic fragmentary top plan of the playing surface sheet used in the present invention showing the playing piece thereon, and FIG. 6 is a section taken on line 6—6 of FIG. 5.

DETAILED DESCRIPTION

Figure 1:
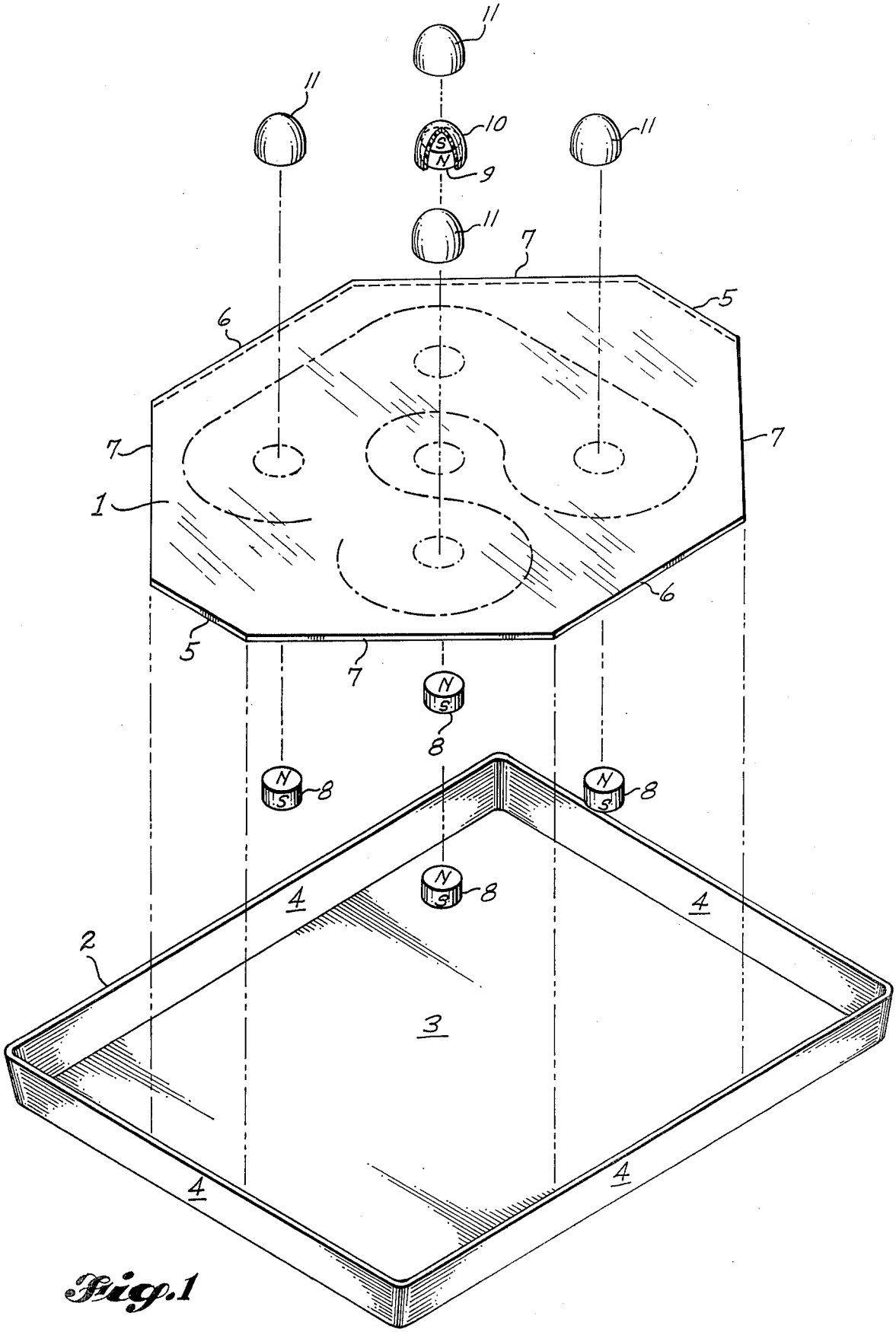
FIG. 1 is an exploded top perspective of magnetic game apparatus in accordance with the present invention.

In the preferred embodiment of the present invention shown in the drawings, a planar octagonal playing surface is formed by the top of a nonmagnetic sheet 1 fitted into an open topped container 2 having a rectangular bottom 3 and upstanding sides 4 flaring slightly outward from the container bottom. Such surface is spaced from and parallel to the container bottom. Opposite edges 5 and opposite edges 6 of the octagonal playing surface sheet are in contiguous engagement with portions of the inner surfaces of the container sides. Sheet edges 7, each extending between an edge 5 and an edge 6, bridge diagonally across and are spaced inward from the corner portions of the container sides. The playing surface sheet may be secured in position by gluing edges 5 and 6 to their respective container sides.

Four board magnets 8 are interposed between the container bottom 3 and the underside of the playing surface sheet 1. Each of such board magnets is located generally midway between the center of the playing surface and an edge 7 of such surface such that the four board magnets are positioned at the four corners of a square. An upper board magnet 9, covered by a dome-shaped decorative cap or nub 10, is mounted on top of the playing surface at its center. A similar nub 11 is secured on top of the playing surface directly over each lower board magnet 8.

Each of the board magnets is a short cylindrical bar magnet, of the same strength as the other magnets, having one of its end faces, that is, one of its poles, in engagement with the playing surface sheet and the other of its end faces or poles farther from such sheet. The board magnets are arranged such that the same pole of each is adjacent to the playing surface.

The final component of game apparatus in accordance with the present invention is a separate playing piece or wobbler 12, best seen in FIG. 4, including a convexly curved bottom 13 for engaging the playing surface; a short cylindrical magnet 14 having one of its poles generally adjacent to and its other pole farther from the wobbler bottom; and a decorative cap 15. The wobbler magnet has the same strength as the board magnets. When the wobbler bottom is placed on the playing surface, the polar orientation of the wobbler magnet is the same as the polar orientation of the board magnets in that the pole of the wobbler magnet generally adjacent to the playing surface corresponds to the pole of each of the board magnets generally adjacent to the playing surface. Consequently, the board magnets provide a magnetic field repelling the wobbler.

The curvature of the wobbler bottom is of larger radius than the radius of its cylindrical body and the wobbler has a low center of gravity because the diameter of the wobbler magnet is substantially greater than its height. Consequently, the wobbler will not tip over if its bottom rests on the playing surface.

The object of the game played with the apparatus of the present invention is to cause the wobbler to traverse a desired circuitous path over the playing surface by manually tilting such surface. As shown in FIG. 6, tilting of the playing surface such that it is inclined downward to the right as shown in that figure, causes the wobbler to tilt such that a point of its convexly curved bottom to the right of its axis 16 moves into engagement with the playing surface. As diagrammatically shown in FIG. 5, if a lower board magnet 8 is near the wobbler, the repelling force between such board magnet and the wobbler magnet causes the wobbler to rotate in the direction indicated by the arrow and move away from the board magnet along the path 17.

Because of the tilting of the playing surface of FIG. 5 and FIG. 6, the wobbler does not follow a linear path directly away from the board magnet, but instead follows an arcuate path curved slightly downhill in the direction the playing surface is tilted.

Movement of the wobbler away from the lower board magnet in FIG. 5 can be accelerated by tilting the playing surface downward generally in the direction of wobbler movement. Such movement continues until the wobbler nears another board magnet. For example, if another board magnet is located to the right of the wobbler shown in FIG. 5 and FIG. 6, as the wobbler nears such other board magnet, it will veer to the left. Naturally, the effect each board magnet has on the wobbler depends to a large degree on the distance between the wobbler and such magnet as compared to the distance between the wobbler and one or more of the other board magnets.

The direction of movement of the wobbler over the playing surface depends not only on the tilting of the playing surface and the location of the wobbler relative to the board magnets, but also on the spinning and/or travelling momentum of the wobbler. For example, with the wobbler travelling away from an adjacent lower board magnet and spinning in the direction indicated in FIG. 5, and with the playing surface inclined downward to the right as shown in FIG. 6, if the playing surface is tilted so that it is inclined downward to the left, the spinning momentum of the wobbler in combination with the repelling force exerted on it by the board magnet causes the wobbler to veer to the right such as along the path 18.

Movement of the wobbler is further complicated by the fact that the upper board magnet 9 is at about the same elevation as the wobbler magnet. Although each pole of the wobbler magnet is repelled equally by the corresponding pole of the upper board magnet, the wobbler has a tendency to tilt away from the upper board magnet because of the friction between the wobbler bottom and the playing surface. In contrast, each lower board magnet is a substantial distance below the wobbler magnet. The upper pole of the wobbler magnet is attracted to the upper pole of each lower board magnet and the lower pole of the wobbler magnet is attracted to the lower pole of each lower board magnet. Again, because of the friction between the wobbler bottom and the playing surface, the wobbler has a tendency to tilt toward an adjacent lower board magnet as shown in FIG. 3.

Tilting of the wobbler toward a magnet below the playing surface and away from a magnet above the playing surface has quite a dramatic effect on the movement of the wobbler. For example, with the relationship of FIG. 5, if the board magnet 8 were located above the playing surface and such surface were tilted as shown in FIG. 6, the wobbler would rotate in the direction indicated by the arrow and follow the spiral path 19 around the board magnet because the wobbler would be tilted away from such magnet.

By expert manipulation of the playing surface, a player can cause the wobbler to traverse virtually any desired circuitous path over the playing surface. The simplest path to traverse is a generally circular path around the upper board magnet and inside the lower board magnets. A more complicated and difficult path is shown in broken lines in FIG. 2. If desired, separate path cards each showing one possible path and having apertures positioned such that the path card can be fitted over the playing surface nubs can be provided. Alternatively, a user could draw a desired path on the playing surface, for example with a crayon or grease pencil, and when desired such path could be erased or rubbed off. A desired path could have a definite starting location and finishing location, such as the path shown in FIG. 2, or any of several possible endless paths could be used.

I claim:

1. In a game apparatus, a generally horizontally disposed nonmagnetic playing surface having upper and lower sides, a plurality of magnets located beneath said playing surface, and a movable playing piece for traversing a circuitous path on said upper side of said playing surface in response to tilting of said playing surface, said playing piece including a magnet and having a convexly curved bottom for bearing on said upper side of said playing surface, said playing piece magnet being disposed such that when said playing piece bottom bears on said upper side of said playing surface one pole of said playing piece magnet is adjacent to said playing surface and the other pole of said playing piece magnet is farther from said playing surface so that said playing piece will revolve and wobble when said playing surface is tilted and the magnetic field of said playing piece magnet interacts with the magnetic field of said magnets beneath said playing surface.

2. In a game apparatus, a generally horizontally disposed nonmagnetic playing surface having upper and lower sides, a plurality of board magnets located beneath said playing surface, and a playing piece wobbler for revolving and traversing a circuitous path on said upper side of said playing surface in response to tilting of said playing surface, said wobbler including a magnet and having a convexly curved bottom for bearing on said upper side of said playing surface, said board magnets and said wobbler magnets being disposed such that when said wobbler bottom bears on said upper side of said playing surface the same pole of each of said board magnets and said wobbler magnet is adjacent to said playing surface and the other pole of each of said board magnets and said wobbler magnet is farther from said playing surface so that said wobbler is repelled by said board magnets.

3. In the apparatus defined in claim 2, the board magnets being stationary relative to the playing surface.

4. In the apparatus defined in claim 2, and a nub secured to the top of the playing surface directly above each of the board magnets.

5. In the apparatus defined in claim 2, four board magnets located beneath the playing surface and located, respectively, at each of the four corners of a square.

6. In the apparatus defined in claim 5, an upper board magnet located above the playing surface at the center of the square.

7. In the apparatus defined in claim 2, all of the magnets being of the same strength.

8. In the apparatus defined in claim 2, an open topped container supporting the playing surface such that the upper side of the playing surface is spaced from the bottom of said container, edge portions of the playing surface being spaced from the inner sides of said container.

9. In the apparatus defined in claim 2, the center of gravity of the playing piece being sufficiently low that the playing piece will not tip over if its convexly curved bottom rests on the playing surface.

10. In the apparatus defined in claim 2, the playing piece magnet being a cylindrical bar magnet having a diameter substantially greater than its height.

11. In a game apparatus, a generally horizontally disposed nonmagnetic playing surface having upper and lower sides, at least two board magnets located, respectively, above and beneath said playing surface and stationary relative to said playing surface, and a playing piece wobbler for revolving and traversing a circuitous path on said upper side of said playing surface in response to tilting of said playing surface, said wobbler including a magnet and having a convexly curved bottom for bearing on said upper side of said playing surface, said board magnets and said wobbler magnet being disposed such that when said wobbler bottom bears on said upper side of said playing surface the same pole of each of said board magnets and said wobbler magnet is adjacent to said playing surface and the other pole of each of said board magnets and said wobbler magnet is farther from said playing surface so that said wobbler is repelled by said board magnets.

12. In a game apparatus, a generally horizontally disposed nonmagnetic playing surface having upper and lower sides, a plurality of board magnets beneath said playing surface, and a movable playing piece for traversing a circuitous path on said upper side of said playing surface in response to tilting of said playing surface, said playing piece including a convexly curved bottom element for bearing on said upper side of said playing surface and a magnet rigidly attached to said bottom element for interaction of the magnetic field of said playing piece magnet with the magnetic field of said board magnets so that said playing piece will revolve and wobble when said playing surface is tilted.

* * * * *